United States Patent [19]

Kemner et al.

[11] Patent Number: 4,949,830

[45] Date of Patent: Aug. 21, 1990

[54] CONTROL APPARATUS FOR A MOTOR, CLUTCH AND GEAR DRIVE ARRANGEMENT

[75] Inventors: Axel Kemner, Isernhagen; Andreas Oberlander, Hannover, both of Fed. Rep. of Germany

[73] Assignee: WABCO Westinghouse Steuerungstechnik GmbH & Co., Hanover, Fed. Rep. of Germany

[21] Appl. No.: 358,726

[22] Filed: May 30, 1989

[30] Foreign Application Priority Data

Sep. 24, 1988 [DE] Fed. Rep. of Germany ..... 3832501

[51] Int. Cl.[5] ..... B60K 41/28; B60K 23/00

[52] U.S. Cl. ..... 192/0.092; 74/878; 200/61.88

[58] Field of Search ..... 192/0.092, 0.094; 74/878; 200/61.88, 61.91

[56] References Cited

U.S. PATENT DOCUMENTS

| | | | |
|---|---|---|---|
| 3,824,879 | 7/1974 | Hansgen et al. | 74/878 |
| 3,842,653 | 10/1974 | Blonn, Sr. | 74/878 |
| 4,022,078 | 5/1977 | Malott | 200/61.88 |
| 4,106,604 | 8/1978 | Baba | 74/878 |

*Primary Examiner*—Dwight Diehl
*Assistant Examiner*—Andrea Pitts
*Attorney, Agent, or Firm*—Buchanan Ingersoll

[57] ABSTRACT

A control apparatus is provided which controls a motor, clutch and drive gear arrangement. The device consists of a movable control lever assembly which moves from a neutral position into at least one other operating position. The control apparatus includes a switching device that is operated as a two-part activating member. The activating member is mounted in a guide arrangement which remains in a fixed position in relationship to such control lever assembly. The activating member can be moved from a neutral position of such control lever assembly into a second position in which the activating member will act upon the switching assembly.

44 Claims, 2 Drawing Sheets

CONTROL APPARATUS FOR A MOTOR, CLUTCH AND GEAR DRIVE ARRANGEMENT

FIELD OF THE INVENTION

The present invention relates, in general, to control equipment and, more particularly, this invention relates to a control apparatus useful in controlling an arrangement that includes each of a motor, a clutch and a gear drive.

BACKGROUND OF THE INVENTION

Although the present invention is not limited thereto, control equipment for controlling a motor, clutch and a gear drive arrangement on a ship, for example, have been taught in the prior art. For an understanding of this type of control device, see German Pat. No. DE-PS 22 19 486.

The control device that is taught in this prior art publication consists of a mechanism which will prevent the undesirable activation of the control links used for the engagement of the clutch when the control lever remains in a position such that, in order to idle the motor for initial warmup, the motor RPM's are brought up to a point where normally the clutch would engage and thereby connect the motor with the gear drive.

This prior art control apparatus consists of a number of disk members. Such disk members are equipped with teeth and lugs which are designed to be engageable with one another during operation of the equipment. It is known that the manufacturing costs associated with this control apparatus is relatively high. In addition, the space requirements for this control apparatus are relatively large.

SUMMARY OF THE INVENTION

The present invention provides a control apparatus for controlling an arrangement which includes each of a motor, a clutch and a gear drive. Each of such motor, clutch and gear drive are positioned on a preselected piece of equipment. The control apparatus includes a housing member which enables mounting such control apparatus in an operating position on such preselected piece of equipment. Such operating position is a position which enables the control apparatus to control the motor, clutch and gear drive arrangement. The housing member includes an aperture that is formed through a wall portion of the housing member at a predetermined location. A control lever assembly is a necessary component of such control apparatus. Such control lever assembly is movably connected to the housing member adjacent a first side of such housing member. The movable connection enables movement of such control lever assembly from a neutral position of such control apparatus into at least one different position. Such at least one different position represents at least one operating position of such control apparatus. The control lever assembly includes a body portion and a handle portion connected to such body portion. A first shaft member is connected to such body portion of the control lever assembly. Such first shaft portion extends through such aperture formed through such side wall portion of the housing member. The first shaft portion provides a movable connection of such control lever assembly to such housing member. A cavity is formed in and adjacent one end of such body portion. This cavity is located intermediate such handle portion and the first shaft member of such control lever assembly. The control apparatus includes a second shaft member that is connected to the first shaft member. A plate-like member is engaged with the second shaft member and a switching assembly is connected to such plate-like member. This switching assembly enables such control apparatus to accommodate both a switching function and a control function. These particular functions occur in response to movement of the control lever assembly. This switching assembly is rigidly mounted in relationship to such control lever assembly. A guide arrangement is positioned adjacent one end of such housing member. Such guide arrangement is positioned substantially in axial alignment with such cavity formed in the body portion of the control lever assembly. The control apparatus includes an activating means. This activating means includes a first portion that is rigidly mounted in the guide arrangement in relationship to such control lever assembly and a second portion that is disposed substantially within the cavity formed in the body portion of the control lever assembly. Such activating means enables activation of such switching assembly. The activating means, in a neutral position of such control lever assembly, is capable of being moved from a first position into a second position. In this second position, such activating means acts upon such switching means. Such activating means is configured as a two-pronged member in a direction that is transverse to an activating direction. Both the cavity formed in the body portion of such control lever assembly and the second portion of the activating means that is disposed within such cavity formed in the body portion of the control lever assembly are sized in a manner such that with such second portion of the activating means disposed in such cavity such second portion of the activating means can by-pass such first portion of such activating means rigidly mounted in the guide arrangement positioned adjacent one end of the housing member. The control apparatus further includes a locking mechanism. Such locking mechanism is engageable with such activating means to enable locking of such activating means. This locking occurs when such activating means is in such second position and when the control lever assembly is in a position that is not the neutral position. Finally, the control apparatus includes a force means for providing a return force. Such return force, in the neutral position of such control lever assembly, is capable of activating the second portion of the activating means in a direction of such cavity formed in the body portion of the control lever assembly.

OBJECTS OF THE INVENTION

It is, therefore, one of the primary objects of the present invention to provide a control apparatus for controlling an arrangement that includes a motor, a clutch and a gear drive which is rather simplistic in design.

Another object of the present invention is to provide a control apparatus for controlling an arrangement which includes a motor, a clutch and a gear drive which is relatively simple to manufacture.

Still another object of the present invention is to provide a control apparatus for controlling an arrangement which includes a motor, a clutch and a gear drive that substantially prevents an inadvertent engagement of the clutch portion of such arrangement.

Yet another object of the present invention is to provide a control apparatus for controlling an arrangement which includes a motor, a clutch and a gear drive wherein movement of an activating member into a shifting position can only occur when a control lever assembly of such control apparatus is in a neutral position.

A still further object of the present invention is to provide a control apparatus for controlling an arrangement which includes a motor, a clutch and a gear drive which is particularly useful in a marine-type application.

In addition to the various objects and advantages of the control apparatus of the present invention described above, various other objects and advantages of such control apparatus will become more readily apparent to those persons who are skilled in the control art from the following more detailed description of the present invention when such description is taken in conjunction with the attached drawing FIGURE and the appended claims.

BRIEF DESCRIPTION OF THE INVENTION

Figure 1:
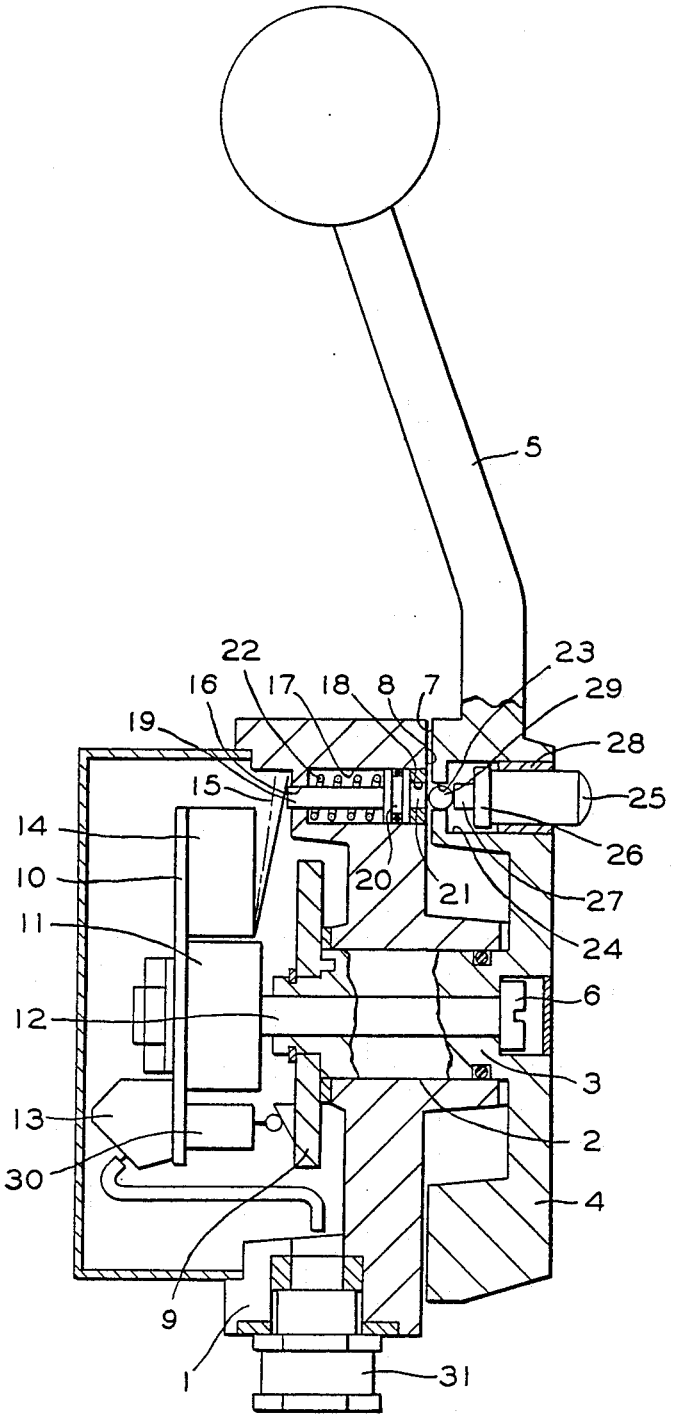
FIG. 1 is a side elevation view partially in cross-section which illustrates a presently preferred embodiment of the control apparatus of this invention.
Figure 2:
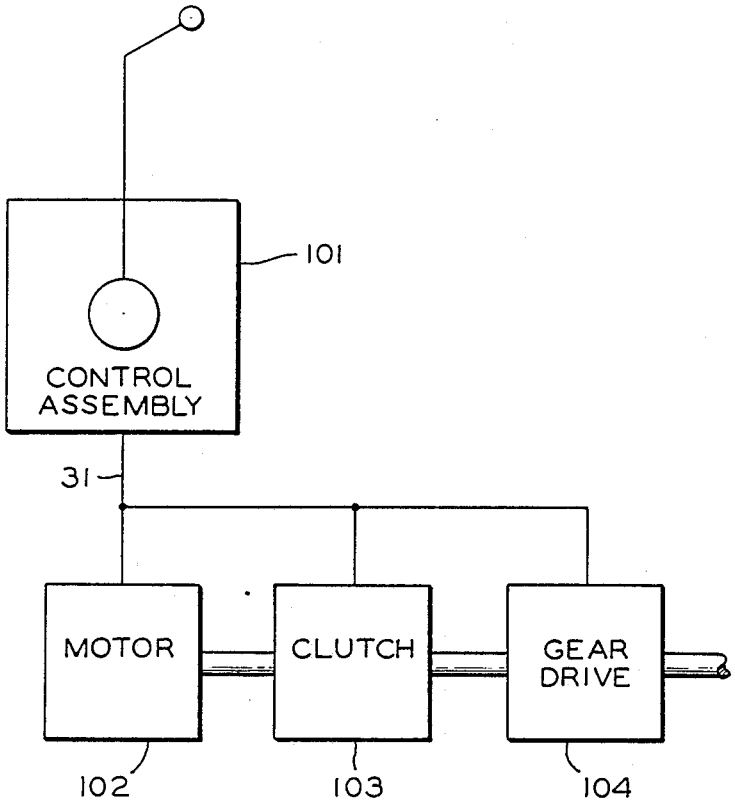
FIG. 2 is a diagrammatic drawing of the motor, clutch, gear drive, and control apparatus.

Now refer more particularly to the drawing wherein there is illustrated a control apparatus 101 having an electrical switch for activating a clutch in an arrangement that includes each of a motor 102, a clutch 103 and a gear drive 104. The control apparatus further includes a divided activating means for a switch which is series switched with another switch as will become clear as the description proceeds.

The control apparatus of this invention includes a mount, hereinafter referred to as housing member 1. Such housing member 1 includes a bore, hereinafter referred to as an aperture 2, that is formed through a wall portion of the housing member 1. Such aperture 2 serves as an opening passage. In addition, the aperture 2 serves as a bearing surface or bearing member for a first shaft member 3. Such first shaft member 3 is the main shaft. The first shaft member 3 is rigidly connected at one face thereof with a receptacle shaped body portion 4 of a control lever assembly. Such control lever assembly also includes a handle portion 5 and will hereinafter be referred to as control lever assembly 4 and 5. Such rigid connection is preferably achieved by means of a bolt. Such bolt will be referred to hereinafter as a second shaft member 6 and 12.

The housing member 1 has a first side which faces the edge of the recessed body portion 4 of the control lever assembly 4 and 5. This edge of such recessed body portion 4 has a substantially flat surface area 7 which faces the housing member 1. In similar fashion, the first side of the housing member 1 which faces the flat surface area 7 of the recessed body portion 4 is provided with a substantially level ring surface 8. Such ring surface 8 faces the flat surface area 7 of the recessed body portion 4 of the control lever assembly 4 and 5.

On an opposite side of such housing member 1, i.e., the side facing away from the control lever assembly 4 and 5, a control disk 9 is provided. Such control disk 9 is mounted on the first shaft member 3. The control disk 9 serves the purpose of both control and shifting. In the presently preferred embodiment of the invention, this control disk 9 is rigidly connected with the first shaft member 3. This rigid connection of the control disk 9 to the first shaft member 3 may be achieved in a number of ways but is illustrated in the drawing as a lug which extends into a mating cavity of such first shaft member 3.

Also mounted on this opposite side of the housing member 1 is a plate-like member 10. Such plate-like member 10 serves as a carrier member for a number of electrical control and switching components required by the control apparatus to carry out the required functions such control apparatus must perform. The plate-like member 10 is positioned substantially parallel to such opposite side of the housing member 1 and is indirectly connected with such housing member 1 by way of the second shaft member 6 and 12.

Positioned on one side of the plate-like member 10 is a number of electrical switches and a potentiometer 11. These electrical switches and the potentiometer 11 serve as switching and control devices which, in the appended claims, are referred to as a switching assembly. The switching assembly controls such functions as forward, return, stop, RPM control of the motor and the engagement of the clutch. The drawing illustrates, for these functions, an electrical switch 30 which is electrically connected to activate the shifting member of the clutch. A second electrical switch 14 and 15, positioned parallel to the first switch 30, is provided for the purpose of breaking the current for the shifting member of such clutch. The potentiometer 11 includes a second shaft member 12, acting as a drive shaft, which is coaxial to the first shaft member 3. The second shaft member 12 is rigidly connected with the first shaft member 3. Preferably such second shaft member 6 and 12 engages the first shaft member 3 in an aperture formed through such first shaft member 3.

Located on the side of the plate-like member 10 which is opposite of the switching assembly switch and control members there is a terminal element 13. Such terminal element 13 enables an electrical hook-up of the control apparatus to a source of power and to the motor, clutch and gear drive arrangement. In addition, the terminals are electrically connected with the switching and control components of the switching assembly by way of conduits. Such conduits may be mounted on top of the plate-like member 10 or they may be set into such plate-like member 10. Cable 31 carries the respective electrical conductors and the signals from the control housing 1 of the control apparatus 101 to the motor 102, clutch 103 and gear drive 104.

Switching lugs may be provided on the control disk 9 to serve as an activator for the switching and control parts of the switching assembly.

A shifting member 15 is provided for the second electrical switch 14, hereinafter referred to in the application as the shifting member 14 and 15. A guide arrangement for the shifting member 14 and 15 is arranged in the form of a stepped bore 16, 17 and 18 located adjacent one end of the housing member 1. Disposed in the stepped bore 16, 17 and 18 is a first portion 19 of an activating means. The first portion 19 of such activating means is positioned in an adjustable manner transversely to the direction of operation of the divided shifting member 15 in the direction of the second electrical switch 14.

In the presently preferred embodiment, of the invention, the first portion 19 of the activating means is shaped as a ram. Such ram has a circular flange 20 connected thereto. The ram and its circular flange 20 are guided in the guide arrangement by the larger section 17 of the bore 16, 17 and 18 and the smaller section 16 of such bore 16, 17 and 18 which delineates the bore 16, 17 and 18 on the side facing the shifting member 14 and 15.

Within the bore 16, 17 and 18 a cylindrical spring 22 is provided. Such cylindrical spring 22 is biased between the stepped portion 16 of the bore 16, 17 and 18 and the circular flange 20 connected to the ram. In addition, the cylindrical spring 22 acts as a backup force for the activating means and forces the ram and circular flange 20 away from the shifting member 14 and 15. On the end located opposite the cylindrical spring 22, the ram includes an extension member 21. This extension member 21 is positioned to slide in the smaller area 18 of the bore 16, 17 and 18 which in turn delineates such bore 16, 17 and 18 on the side of the recessed body portion 4 of the control lever assembly 4 and 5.

Substantially in axial alignment with the bore 16, 17 and 18 formed adjacent one end of the housing member 1, the outer edge of the recessed body portion 4 of the control lever assembly 4 and 5 has a stepped bore formed therein. Such stepped bore formed in such recessed body portion 4 of the control lever assembly 4 and 5 will be referred to as a cavity 23 and 24. Positioned in the cavity 23 and 24 is a second portion of the activating means. This second portion of the activating means includes an activating element 25 located in the longitudinal direction of the cavity 23 and 24 in an adjustable manner.

It is presently preferred that the activating element 25 be configured as a second ram member 25. This second ram member 25 includes a flange member 26. The second ram member 25 is guided by an externally threaded bushing 28. The bushing 28 is threadedly engaged in a threaded portion of the cavity formed in the recessed body portion 4 of the control lever assembly 4 and 5 on the side which faces away from the housing member 1. The second ram member 25 has an extension portion 27 on the side which faces the housing member 1. Upon movement of the second ram member 25 against the first ram, the extension portion 27 of the second ram member 25 moves into the smaller section 23 of the cavity 23 and 24 formed in the body portion 4 of the control lever assembly 4 and 5.

Between the facing sides of the first portion 19 of the activating means positioned adjacent one end of the housing member 1 and the activating element 25 of the second portion of such activating means positioned in the cavity 23 and 24 formed in the body portion 4 of the control lever assembly 4 and 5 a second member of such second portion of the activating means is located. This second member is preferably shaped as a ball member 29. It should be understood, however, that this second part of the second portion of the activating means can be shaped as a different configuration, for instance, in cylindrical form.

In any case, this second part will preferably be shaped the same as the extension portion 21 of the first portion of the activating means or as the extension portion 27 of such activating element 25, 26 and 27. The cross-section of the adjoining areas 18 and 23 of the first bore 16, 17 and 18 located at one end of the housing member 1 and the cavity 23 and 24 formed in the recessed body portion 4 of the control lever assembly 4 and 5 as well as the cross-section of the second portion of the activating means are sized in a manner such that the second portion of such activating means is guided during movement of such activating means with a minimum amount of play in these adjoining areas 18 and 23.

The axial path of these adjoining areas 18 and 23 of the bore 16, 17 and 18 and the cavity 23 and 24, respectively, and the path of the activating element 25 are sized in a manner such that second part 29 cannot enter into the respective larger areas 17 and 23 of the bore 16, 17 and 18 and the cavity 23 and 24 and thereby loose its guide. Although it is presently preferred, it is not essential for the bore 16, 17 and 18 located at such one end of the housing member 1 or the cavity 23 and 24 located in the recessed body portion 4 of the control lever assembly 4 and 5 to be stepped. It is, however, preferred that they have substantially the same constant cross-section over their axial path. The bore 16, 17 and 18 and the cavity 23 and 24 can be cylindrical or of any other cross-section, for example, square or oval.

Likewise, it is preferred that the first portion 19 of the activating means and the second part 29 and the activating member 25 of the second portion of such activating means have substantially the same constant cross-section. In this case, the circular flange 20 and the additional extension member 21 of the first portion 19 of such activating means and the activating element 25 of the second portion of such activating means can be dispensed with. This design will simplify the manufacturing of such control apparatus and thereby lower the production cost.

In using bores of such a design, it will require that the portion of the ram members positioned outside of their respective bore must be equipped with detents. Such detents being provided to limit the length of a stroke of such rams.

The operating function of the control apparatus described above will now be explained in some detail below.

For the purpose of understanding the advantages of the control apparatus of the present invention, it is to be assumed that after startup of the motor of a ship such motor is expected to warm up at a relatively high RPM without any movement of the control lever assembly 4 and 5 which, for this purpose, should activate a switch by means of a control member for the clutch on the longitudinal axis of the first shaft member 3. The activating element 25, which protrudes from the cavity 23 and 2 formed in the recessed body portion 4 of the control lever assembly 4 and 5, for the activation means is forced into such cavity 23 and 24 of the control lever assembly in the direction of the housing member 1. In the neutral position of the control lever assembly 4 and 5, the bore 16, 17 and 18 located adjacent such one end of the housing member 1 and the cavity 23 and 24 formed in the recessed body portion 4 of the control lever assembly 4 and 5 are located substantially opposite each other. The second part 29 of the second portion of the activating means is forced from the cavity 23 and 24 of the control lever assembly and into the bore 16, 17 and 18 of the housing member 1. This process moves the first portion 19, 20 and 21 of the activating means and the activating member 25 and the second part 29 of the second portion of such activating means in the direction of the switching member 15 of the electrical switch 14 an 15. The first portion 19, 20 and 21 of the activating means thereby moves the switching member 15 of the electrical switch 14 and 15 into a position in which the electrical switch 14 and 15 is shifted in a manner such that the electrical current supply to the clutch control portion of the motor, clutch and gear drive arrangement is interrupted.

During this process, the second part 29, of the second portion of the activating means, moves out of the cavity 23 and 24 formed in the control lever assembly 4 and 5 and into the bore 16, 17 and 18 located adjacent one end of the housing member 1. This then enables the control lever assembly 4 and 5 to be moved about the longitudinal axis of the first shaft member 3 into a position which allows an increase in the RPM's of the motor.

When moving the control lever assembly 4 and 5, as described above, from its neutral position the relatively flat surface area 7 on the recessed body portion 4 of such control lever assembly 4 and 5 will by-pass the bore 16, 17 and 18 located in such one end of the housing member 1 and cover such bore 16, 17 and 18. The control lever assembly 4 and 5, or another component (not shown) connected to it, will serve as a locking element for the activating member 25 of the second portion of the activating means. The second part 29 of the second portion of such activating means is held in place in the bore 16, 17 and 18 located in the housing member 1 by the flat surface area 7 on the recessed body portion 4 of the control lever assembly 4 and 5.

After the motor reaches the desired temperature, the control lever assembly 4 and 5 is returned to its neutral position. Once the control lever assembly 4 and 5 is in the neutral position, by way of the force being exerted by the spring 22, the first portion 19, 20 and 21 of the activating means will be shifted in the direction of such control lever assembly 4 and 5. This results in the second part 29 being forced out of the bore 16, 17 and 18 located at one end of the housing member 1 and back into the cavity 23 and 24 formed in the recessed body portion 4 of the control lever assembly 4 and 5. As soon as the second part 29 of the second portion of the activating means has penetrated completely back into the cavity 23 and 2 in such body portion 4 of the control lever assembly 4 and 5 such control lever assembly 4 and 5 is again capable of moving about the longitudinal axis of the first shaft member 3. In this position of the activating means, the current supply to the electrical switch which activates the control member for the clutch portion of the motor, clutch and gear drive arrangement is no longer interrupted and the clutch can again be activated upon movement of the control lever assembly 4 and 5 about the longitudinal axis of the first shaft member 3.

The second part 29 of the second portion of the activating means is held in place, in the cavity 23 and 24 formed in the recessed body portion 4 of the control lever assembly 4 and 5, when the switching mechanism 14 and 15 is not activated and the control lever assembly 4 and 5 is outside of the neutral position by the relatively flat surface area 8 on the housing member 1. Because the ram member 19 of the first portion of the activating means and the ball member 29 of the second portion of the activating means are interlocked, an inadvertent shifting, i.e., disengaging, of the clutch is not possible. In other words, the ram member 19 of the first portion of the activating means and the ball member 29 of the second portion of the activating means will pass each other when the activating element 25 of such second portion of the activating means is not activated.

The extension member 21 forming a portion of the first portion of the activating means, located at one end of the housing member 1, and the extension member 27 forming a portion of the second portion of such activating means, located in the cavity 23 and 24 formed in the recessed body portion 4 of the control lever assembly, are sized in a manner such that the extension member 21 of such first portion of the activating means cannot enter the cavity 23 and 24 of the second portion of the activating means nor can the extension member 27 of the second portion of the activating means enter the bore 16, 17 and 18 of the first portion of the activating means and thereby prevent movement of the control lever assembly 4 and 5.

To prevent such an undesirable entry of the extension member 21 of the first portion of the activating means into the cavity 23 and 24 formed in the control lever assembly and the extension member 27 of the second portion of the activating means into the bore 16, 17 and 18 located at one end of the housing, respectively, the cavity 23 and 24 and the bore 16, 17 and 18 can be stepped and the stepped portions can act as stop members for the flange 20 on the first portion of the activating means and the flange 26 on the second portion of the activating means. As discussed above, the various parts forming each of the first portion and the second portion of the activating means can have any desirable cross-sectional shape.

It can be seen from the above description of the control apparatus and its operation that the invention provides the advantage of a relatively simple construction and safe mechanism which prevents an inadvertent engagement of the clutch portion of a motor, clutch and gear drive arrangement. This is accomplished by the invention through the use of a shifting mechanism which is activated by a guided carrier and a divided activating means which slides in a groove of the control lever assembly 4 and 5. The control apparatus of the present invention offers the advantage of enabling the movement of the activating element 25 into a shifting position only when the control lever assembly 4 and 5 is in a neutral position.

In the control apparatus of the present invention, when the activating element 25 has been brought into a position, whereby such activating element 25 will activate the shifting mechanism 15, the control lever assembly 4 and 5, or a part connected to such control lever assembly 4 and 5, will act as a locking mechanism for the shifting mechanism when it is positioned in a position other than a neutral position.

The above-described control apparatus is not only useful for controlling ships, but such control apparatus can be used to advantage for any system, or installation, which requires a control of a switching system. This control apparatus is particularly useful in a control system that is expected to accomplish a control function with a control lever arrangement in addition to a switching function.

It should also be understood that the switching mechanism 14 and 15 can be built as an electrical switch, as is presently preferred, however, such switching mechanism 14 and 15 can also function as a mechanical switching mechanism which can, for example, act jointly with a control disk which is located on the first shaft member 3.

Likewise, it should be understood that the remaining switching and control devices which have been described above as electrical switches and control devices can be replaced by purely mechanical switching and control devices.

Although a number of presently preferred and alternative embodiments of the control apparatus of the present invention have been described in detail above, it should be obvious to those persons who are skilled in the control art that various other modifications and adaptations of the control apparatus to control a motor, clutch and gear drive arrangement can be made without departing from the spirit and scope of the appended claims.

We claim:

1. A control apparatus for controlling an arrangement which includes each of a motor, a clutch and a gear drive positioned on a preselected piece of equipment, said control apparatus comprising:

(a) a housing member for mounting said control apparatus in an operating position on such preselected piece of equipment to control said each of said motor, said clutch and said gear drive, said housing member includes an aperture formed through a wall portion thereof;

(b) a control lever assembly movably connected to said housing member adjacent a first side of said housing member to enable movement of said control lever from a neutral position of said control apparatus into at least one different position which represents at least one operating position of said control apparatus, said control lever assembly includes;

(i) a body portion, (ii) a handle portion connected to said body portion, (iii) a first shaft member connected to said body portion and extending through said aperture formed through said wall portion of said housing member to enable a movable connection of said control lever assembly to said housing member, and (iv) a cavity formed in and adjacent one end of said body portion intermediate said handle portion and said first shaft member;

(c) a second shaft member connected to said first shaft member;

(d) a plate-like member connected to said second shaft member;

(e) a switching assembly connected to said plate-like member, said switching assembly enables said control apparatus to accommodate both a switching function and a control function in response to movement of said control lever assembly, said switching assembly is rigidly mounted in relationship to said control lever assembly;

(f) a guide arrangement positioned adjacent one end of said housing member in axial alignment with said cavity formed in said body portion of said control lever assembly;

(g) an activating means having a first portion rigidly mounted in said guide arrangement in relationship to said control lever assembly and a second portion disposed in said cavity in said body portion of said control lever assembly for activating said switching assembly, said activating means, in a neutral position of said control lever assembly, is capable of being moved from a first position into a second position in which said activating means will act upon said switching means, said cavity formed in said body portion of said control lever assembly and said second portion of said activating means disposed in said cavity formed in said body portion of said control lever assembly are each sized in a manner such that with said second portion of said activating means disposed in said cavity said second portion of said activating means can by-pass said first portion of said activating means;

(h) a locking mechanism engageable with said activating means to lock said activating means when said activating means is in said second position and when said control lever assembly is in a position other than a neutral position; and (i) a force means for providing a return force which, in said neutral position of said control lever assembly, is capable of activating said second portion of said activating means in a direction of said cavity formed in said body portion of said control lever assembly.

2. A control apparatus, according to claim 1, wherein said control lever assembly is rotatably connected to said housing member.

3. A control apparatus, according to claim 1, wherein said control guide arrangement for said activating means is mounted in said housing member.

4. A control apparatus, according to claim 2, wherein said control guide arrangement for said activating means is mounted in said housing member.

5. A control apparatus, according to claim 3, wherein said guide arrangement is configured as a bore.

6. A control apparatus, according to claim 5, wherein said bore includes a step-like portion.

7. A control apparatus, according to claim 1, wherein said cavity formed in said body portion of said control lever assembly is configured as a bore which penetrates said body portion of said control lever assembly.

8. A control apparatus, according to claim 1, wherein said bore in said body portion of said control lever assembly includes a step-like portion.

9. A control apparatus, according to claim 1, wherein said body portion of said control lever assembly and said housing member each include a flat surface area on a side opposite to each other at least in an area of a respective one of said cavity in said body portion of said control lever assembly containing said second portion of said activating means and said guide arrangement adjacent said one end of said housing member containing said first portion of said activating means rigidly mounted therein.

10. A control apparatus, according to claim 1, wherein said first portion of said activating means is configured as a ram which is moved by a spring means engaging said ram, said spring means acting as a return force in a direction of said second portion of said activating means contained within said cavity of said body portion of said control lever assembly.

11. A control apparatus, according to claim 3, wherein said first portion of said activating means is configured as a ram which is moved by a spring means engaging said ram, said spring means acting as a return force in a direction of said second portion of said activating means contained within said cavity of said body portion of said control lever assembly.

12. A control apparatus, according to claim 5, wherein said first portion of said activating means is configured as a ram which is moved by a spring means engaging said ram, said spring means acting as a return force in a direction of said second portion of said activating means contained within said cavity of said body portion of said control lever assembly.

13. A control apparatus, according to claim 7, wherein said first portion of said activating means is configured as a ram which is moved by a spring means engaging said ram, said spring means acting as a return force in a direction of said second portion of said activating means contained within said cavity of said body portion of said control lever assembly.

14. A control apparatus, according to claim 1, wherein said second portion of said activating means is configured as a ball-like member.

15. A control apparatus, according to claim 10, wherein said second portion of said activating means is configured as a ball-like member.

16. A control apparatus, according to claim 1, wherein said first portion of said activating means and said guide arrangement for said first portion of said activating means having an axial length such that a penetration of said second portion of said activating means into said guide arrangement is prevented when said second portion of said activating means is already present in said cavity formed in said body portion of said control lever assembly during an oscillating movement of said control lever assembly.

17. A control apparatus, according to claim 10, wherein said first portion of said activating means and said guide arrangement for said first portion of said activating means having an axial length such that a penetration of said second portion of said activating means into said guide arrangement is prevented when said second portion of said activating means is already present in said cavity formed in said body portion of said control lever assembly during an oscillating movement of said control lever assembly.

18. A control apparatus, according to claim 14, wherein said first portion of said activating means and said guide arrangement for said first portion of said activating means are having an axial length such that a penetration of said second portion of said activating means into said guide arrangement is prevented when said second portion of said activating means is already present in said cavity formed in said body portion of said control lever assembly during an oscillating movement of said control lever assembly.

19. A control apparatus, according to claim 15, wherein said first portion of said activating means and said guide arrangement for said first portion of said activating means having an axial length such that a penetration of said second portion of said activating means into said guide arrangement is prevented when said second portion of said activating means is already present in said cavity formed in said body portion of said control lever assembly during an oscillating movement of said control lever assembly.

20. A control apparatus, according to claim 1, wherein said first portion of said activating means and a switching member engageable with said second portion of said activating means include a ledge portion disposed transverse to a respective longitudinal axis which rests on a stop member positioned on said housing member and a stop member on said body portion of said control lever assembly, respectively, these stop members are positioned in a manner such that a penetration of said first portion of said activating means into said cavity formed in said body portion of said control lever assembly and a penetration of said switching member into said guide arrangement for said second portion of said activating means disposed in said housing member is prevented.

21. A control apparatus, according to claim 10, wherein said first portion of said activating means and a switching member engageable with said second portion of said activating means include a ledge portion disposed transverse to a respective longitudinal axis which rests on a stop member positioned on said housing member and a stop member on said body portion of said control lever assembly, respectively, these stop members are positioned in a manner such that a penetration of said first portion of said activating means into said cavity formed in said body portion of said control lever assembly and a penetration of said switching member into said guide arrangement for said second portion of said activating means disposed in said housing member is prevented.

22. A control apparatus, according to claim 16, wherein said first portion of said activating means and a switching member engageable with said second portion of said activating means include a ledge portion disposed transverse to a respective longitudinal axis which rests on a stop member positioned on said housing member and a stop member on said body portion of said control lever assembly, respectively, these stop members are positioned in a manner such that a penetration of said first portion of said activating means into said cavity formed in said body portion of said control lever assembly and a penetration of said switching member into said guide arrangement for said second portion of said activating means disposed in said housing member is prevented.

23. A control apparatus, according to claim 1, wherein said first shaft member is rigidly connected to said body portion of said control lever assembly.

24. A control apparatus, according to claim 23, wherein said first shaft member is a main shaft rotatably mounted in said aperture in said wall portion of said housing member.

25. A control apparatus, according to claim 24, wherein said control apparatus further includes an activating means connected to said main shaft member for operating switching and control elements connected to said plate-like member.

26. A control apparatus, according to claim 25, wherein said control apparatus further includes a switching member engageable at a first end thereof with said first portion of said activating means and at a second end thereof with a portion of said switching assembly in a manner such that said switching member is moved into a pair of switching positions by way of said activating means.

27. A control apparatus, according to claim 26, wherein said first portion of said activating means is mounted in said guide arrangement positioned adjacent said one end of said housing member in a direction of said switching member of said portion of said switching assembly and is movable toward and away from said portion of said switching assembly.

28. A control apparatus, according to claim 27, wherein said second portion of said activating means is disposed in said cavity formed in said body portion of said control lever assembly in a direction of said first portion of said activating means and is movable toward and away from said first portion of said activating means.

29. A control apparatus, according to claim 28, wherein said cavity formed in said body portion of said control lever assembly includes a switching element which forms a part of said second portion of said activating means, said switching element is movable in a manner to enable said activating means to move in a direction toward said switching assembly.

30. A control apparatus, according to claim 29, wherein said guide arrangement positioned adjacent said one end of said housing member and said cavity formed in said body portion of said control lever assembly are positioned adjacent each other and are arranged on an axis substantially parallel to each other.

31. A control apparatus, according to claim 30, wherein said guide arrangement positioned adjacent said one end of said housing member and said cavity formed in said body portion of said control lever assembly and said first portion of said activating means and said second portion of said activating means are each sized in a manner such that when a sliding motion occurs by at least one of said first portion of said activating means and said switching element of said second portion of said activating means in a direction of a respective other part then said second portion of said activating means will slide completely into at least one of said guide arrangement for said first portion of said activating means and said cavity formed in said body portion of said control lever assembly and with a subsequent rotating motion of said control lever assembly said second portion of said activating means will be held in at least one of said guide arrangement and said cavity formed in said body portion of said control lever assembly and said housing member by said control lever assembly.

32. A control apparatus, according to claim 31, wherein said control lever assembly acts as said locking mechanism.

33. A control apparatus, according to claim 1, wherein said aperture formed through said wall portion of said housing member is substantially centrally located.

34. A control apparatus, according to claim 33, wherein said aperture formed through said wall portion of said housing member is substantially round.

35. A control apparatus, according to claim 34, wherein said housing member further includes an extension member which extends toward said body portion of said control lever assembly adjacent said aperture, said extension member having an aperture formed therethrough substantially identical to said aperture formed through said wall portion of said housing member.

36. A control apparatus, according to claim 35, wherein said first shaft member includes an aperture formed therethrough and said second shaft member is disposed coaxial to and in said aperture formed in said first shaft member.

37. A control apparatus, according to claim 36, wherein said aperture formed in said first shaft member is substantially round.

38. A control apparatus, according to claim 37, wherein said second shaft member is rigidly connected to said first shaft member.

39. A control apparatus, according to claim 35, wherein said control apparatus further includes a bearing member positioned intermediate an end of said extension member on said housing member and a surface on said body portion of said control lever assembly.

40. A control apparatus, according to claim 39, wherein said control apparatus further includes a bearing member positioned around said main shaft member and intermediate said housing member and said plate-like member.

41. A control apparatus, according to claim 38, wherein said second shaft member is a bolt.

42. A control apparatus, according to claim 1, wherein said preselected piece of equipment is a vessel which moves on water.

43. A control apparatus, according to claim 1, wherein said control apparatus further includes a protective cover means engageable with said housing member for protecting said switching assembly against environmental conditions.

44. A control apparatus, according to claim 1, wherein said control apparatus further includes an electrical terminal connection means secured to said plate-like member for electrically connecting said control apparatus to an electrical power source and to said arrangement to be controlled.

* * * * *

UNITED STATES PATENT AND TRADEMARK OFFICE

CERTIFICATE OF CORRECTION

PATENT NO. : 4,949,830

DATED : August 21, 1990

INVENTOR(S) : AXEL KEMNER, ANDREAS OBERLANDER

It is certified that error appears in the above-identified patent and that said Letters Patent is hereby corrected as shown below:

At 57, Abstract, line 2, after "The", insert --control--.

Column 3, line 28, change "drawing" to --drawings--.

Column 6, line 47, change "2" to --24--.

Column 7, line 38, change "2" to --24--.

Signed and Sealed this

Twenty-fourth Day of December, 1991

*Attest:*

HARRY F. MANBECK, JR.

*Attesting Officer*

*Commissioner of Patents and Trademarks*